US007885572B2

(12) United States Patent
Nishio et al.

(10) Patent No.: US 7,885,572 B2
(45) Date of Patent: Feb. 8, 2011

(54) CORONA DISCHARGE DEVICE, PHOTORECEPTOR CHARGER, AND METHOD FOR MAKING DISCHARGE PRODUCT REMOVING MEMBER

(75) Inventors: Shigeru Nishio, Yamatokoriyama (JP); Tadashi Iwamatsu, Nara (JP); Yuhsuke Ebata, Suzuka (JP)

(73) Assignee: Sharp Kabushiki Kaisha, Osaka (JP)

( * ) Notice: Subject to any disclaimer, the term of this patent is extended or adjusted under 35 U.S.C. 154(b) by 178 days.

(21) Appl. No.: 12/298,651

(22) PCT Filed: Apr. 25, 2007

(86) PCT No.: PCT/JP2007/058909

§ 371 (c)(1),
(2), (4) Date: Oct. 27, 2008

(87) PCT Pub. No.: WO2007/125936

PCT Pub. Date: Nov. 8, 2007

(65) Prior Publication Data

US 2009/0074463 A1 Mar. 19, 2009

(30) Foreign Application Priority Data

Apr. 28, 2006 (JP) ..... 2006-127049

(51) Int. Cl.
*G03G 21/00* (2006.01)
*G03G 21/20* (2006.01)

(52) U.S. Cl. ..... 399/98; 399/93

(58) Field of Classification Search ..... 399/93, 399/98, 170, 172, 311; 250/324, 325
See application file for complete search history.

(56) References Cited

U.S. PATENT DOCUMENTS 3,723,598 A * 3/1973 Spedden et al. ..... 423/243.03
3,736,424 A * 5/1973 Cecil et al. ..... 250/324

(Continued)

FOREIGN PATENT DOCUMENTS

EP 0 398 262 A2 11/1990

(Continued)

OTHER PUBLICATIONS

International Search Report and partial English translation thereof mailed Jul. 17, 2007 in corresponding PCT application PCT/JP2007/058909.

(Continued)

*Primary Examiner*—Sandra L Brase
(74) *Attorney, Agent, or Firm*—Nixon & Vanderhye, PC

(57) ABSTRACT

A corona discharge device (10) comprises a discharge electrode (1) for causing electric discharge, a discharge product removing member (4) provided around the discharge electrode (1), and containing a material capable of removing a discharge product, and a shield plate (3) interposed between the discharge electrode (1) and the discharge product removing member (4), having a through-hole (3*a*) open toward the discharge electrode (1), and having a surface opposed to the discharge electrode (1) and at least the surface being made of a metallic material. With this, a corona discharge device, a photoreceptor charger, and a method for making a discharge product removing member which realize high trapping efficiency for discharge products and a long life of a discharge product removing filter are provided.

18 Claims, 11 Drawing Sheets

U.S. PATENT DOCUMENTS

| | | | | |
|---|---|---|---|---|
| 4,920,266 | A * | 4/1990 | Reale | 250/324 |
| 5,018,045 | A | 5/1991 | Myochin et al. | |
| 5,142,328 | A * | 8/1992 | Yoshida | 399/93 |
| 5,568,230 | A * | 10/1996 | Reddy et al. | 399/170 X |
| 6,060,708 | A * | 5/2000 | Grubner | 250/324 |
| 7,065,310 | B2 * | 6/2006 | Maeda et al. | 399/93 |
| 7,236,715 | B2 * | 6/2007 | Nishida et al. | 399/93 |
| 2004/0170444 | A1 | 9/2004 | Yamada | |

FOREIGN PATENT DOCUMENTS

| | | | |
|---|---|---|---|
| JP | 64-51949 | U | 3/1989 |
| JP | 1-237569 | A | 9/1989 |
| JP | 2-259673 | | 10/1990 |
| JP | 02-273764 | | 11/1990 |
| JP | 2-273764 | A | 11/1990 |
| JP | 02-303518 | | 12/1990 |
| JP | 03-094812 | | 4/1991 |
| JP | 3-94812 | A | 4/1991 |
| JP | 4-63370 | | 2/1992 |
| JP | 6-317974 | A | 11/1994 |
| JP | 2001-75338 | A | 3/2001 |
| JP | 2006-106453 | A | 4/2006 |

OTHER PUBLICATIONS

International Search Report for PCT/JP2007/058909 mailed Jul. 17, 2007.

Microfilm of the specification and drawings annexed to the request of Japanese Utility Model Application No. 145391/1987 (Laid-open No. 51949/1989) (Richoh Co., Ltd.), Mar. 30, 1989.

* cited by examiner

CORONA DISCHARGE DEVICE, PHOTORECEPTOR CHARGER, AND METHOD FOR MAKING DISCHARGE PRODUCT REMOVING MEMBER

This application is the U.S. national phase of International Application No. PCT/JP2007/058909 filed 25 Apr. 2007, which designated the U.S. and claims priority to Japanese Application No(s) 2006-127049 filed 28 Apr. 2006, the entire contents of each of which are hereby incorporated by reference.

TECHNICAL FIELD

The technology relates to a corona discharge device, which performs a corona discharge toward an electrostatic latent image of an electrophotographic copier so as to supply an electric charge, a photoreceptor charger, and a method for making a discharge product removing member, in particular, to a removal of discharge products which are generated during a corona discharge.

BACKGROUND ART

Normally, in the field of electrophotographic copying process, a corona discharge device is widely used as a device for uniform electric charging of a photoreceptor drum or a device for transferring a toner image formed on a photoreceptor drum to a belt or paper.

In a corotron or a scorotron as the corona discharge device, a corona discharge is performed in the air. Therefore, ozone and nitrogen oxide are generated by a reaction of an oxygen molecule with an active particle of oxygen or nitrogen generated by a non-elastic collision between an electrically charged particle and an oxygen molecule or a nitrogen molecule, the electrically charged particle being accelerated in a discharging field. An exhaust fan provided in an electrophotographic copier releases air containing ozone and the like to the outside. However, ozone is a gas which has a strong odor. Ozone is harmful to human because it may cause physiologic effects such as short breath, dizziness, headache, and nausea when a person is exposed to an air at about 0.1 ppm ozone concentration.

Further, ozone and nitrogen oxide generated by a corona discharge device are adhered to a surface of a photoreceptor drum provided opposing to the corona discharge device and then absorb moisture under a highly humid condition. This reduces a surface resistance of the photoreceptor drum, thereby resulting in image deficiencies such as a fog of a toner image. Further, ozone has a strong chemical action so that it is difficult to maintain a stable electric charge supply when a chemical reaction progresses between ozone and various types of photoreceptors such as an organic photoreceptor.

Therefore, a corona discharge device has been widely used conventionally, which can remove discharge products (products produced in the discharging) such as ozone and nitrogen oxide, from the air to be released from an electrophotographic copier to the outside and which can prevent of the contamination to a photoreceptor.

For example, in a corona discharge device 100 disclosed in a patent document 1, a shield member 101 has a discharge product removing material such as manganous oxide on its surface as illustrated in FIG. 15 (*a*), FIG. 15 (*b*), and FIG. 15 (*c*).

The shield member 101 has a shape of long and narrow box that is open on one side and has a cross-section that looks like a U shape. Inside the shield member 101, insulating blocks 102 and 103 are provided and a wire 104 as a discharge electrode is extended between the insulating blocks 102 and 103. The shield member 101 is made of a paper material 107 in which a flat paper board 105 is coated with a conductive sheet 106, the paper material 107 being bent in the shape.

The conductive sheet 106 is a sheet, for example, an activated carbon sheet, or a metal sheet coated with a metal such as nickel or aluminum by plating or deposition. Note that the activated carbon sheet includes noble metals such as manganous oxide, titanic oxide, Pt, Pd, and Ru.

Therefore, when discharge products such as ozone and titanic oxide, which were generated around the wire 104 during an electric discharge, arrive at a surface of the shield member 101, the discharge products contact and react with the discharge product removing material. As a result, ozone and nitrogen oxide change into an oxygen molecule and nitric acid respectively, thereby becoming collectable.

Further, in a corona discharge device 200 disclosed in a patent document 2, a shield member 201 internally has, i.e. inside a corona discharging field, a discharge product removing member 202 on which manganous oxide or the like is provided, as illustrated in FIG. 16, FIG. 17 (*a*), and FIG. 17 (*b*).

The discharge product removing member 202 has a lot of through-holes 203. Therefore, the through-holes 203 allow ion stream to pass therethrough. In other words, the discharge products in the ion wind refluxing inside the shield member 201 are collected inside the discharge product removing member 202.

Further, instead of using the ion wind refluxing inside the shield member 201, it is possible to collect discharge products by forcibly aspirating air with use of an exhaust air duct 204 and an exhaust fan 205, which are provided at the back of the discharge product removing member 202.

Patent Document 1: Japanese Unexamined Patent Application, Tokukaihei, 2-259673 (date of publication: Oct. 22, 1990)

Patent Document 2: Japanese Unexamined Patent Application, Tokukaihei, 6-317974 (date of publication: Nov. 15, 1994)

DISCLOSURE OF TECHNOLOGY

The conventional corona discharge devices 100 and 200, however, have problems in that it is not possible to realize high trapping efficiency for discharge products and a long life of a discharge product removing filter.

For example, in the patent document 1, discharge products are collected to remove, when they contact and react with manganous oxide, which is formed on a surface of the conductive sheet 106 provided on a surface of the shield member 101. Ion wind including discharge products flows from around the wire 104, which generates a high electric field, to the shield member 101, because the discharge electrode is wire shaped. Therefore, the surface of the conductive sheet 106 is the only place utilized for removing discharge products, thereby resulting in a low trapping efficiency for discharge products.

In the patent document 2, as illustrated in FIG. 17 (*a*), a discharge electrode 206 has a board like shape so that ion wind is likely to flow in the tip-end direction of the discharge electrode 206 (which generates a high electric field), i.e., in a direction toward a photoreceptor 210. Some ion wind refluxes a shield member 201, but a lot of ion wind flows out to a side of the photoreceptor 210 via a grid 207 without flowing back.

If ion wind is forcibly aspirated in a direction reverse to an electric discharge generating direction so as to forcibly cause an ion flow, the amount of electric charge supply during a corona discharge becomes unstable. In a case of supplying a certain amount of electric charge stably, for example, in a case of a uniform charging of the photoreceptor 210, the active aspiration in the reverse direction cannot be used. This causes a low contact efficiency between discharge products and a discharge product removing member 202, thereby resulting in a low trapping efficiency for discharge products.

Further, in the patent documents 1 and 2, a surface of the conductive sheet 106, which covers a surface of the shield member 101, and a surface of the discharge product removing member 202 are exposed to continuously generated ion wind during a corona discharge inside a corona discharging area. When ion generated during an electric discharge reaches the surface of the conductive sheet 106 or the surface of the discharge product removing member 202, an irreversible chemical reaction occurs between ion and a discharge product removing material. As a result, the conductive sheet 106 and the discharge product removing member 202 are degenerated. If the degeneration progresses, a performance as a discharge product removing filter declines.

For example, in a case where a corona discharge was performed with use of the conductive sheet 106 covered with manganous oxide, which originally had a black color, gradually turns to white. Accordingly, a catalytic action for ozone collection maintains only a few hours.

The technology is made in view of the forgoing conventional problems. An object of the technology is to provide a corona discharge device and a photoreceptor charger, which can achieve high trapping efficiency for discharge products and a long life of a discharge product removing filter, and to provide a method for making a discharge product removing member.

In order to attain the object, a corona discharge device includes a discharge electrode for causing electric discharge, a discharge product removing member provided around the discharge electrode, and containing a material capable of removing discharge products, a shield member interposed between the discharge electrode and the discharge product removing member, having a through-hole open toward the discharge electrode, and having a surface opposed to the discharge electrode, and at least the surface being made of a metallic material.

The through-hole of the shield member allows airflow, which was generated in the vicinity of the discharge electrode and reached a surface of the shield member, to lead efficiently and uniformly to the discharge product removing member provided at the back of the shield member.

With the structure, it is possible to collect charged particles, such as an ion and an electron, in airflow components reached the metallic surface of the shield member by using an electric field. Namely, in the airflow components, atmospheric components such as an oxygen molecule and a nitrogen molecule and discharge products such as ozone and nitrogen oxide (NOx) generated during an electric discharge can go through the through-hole in the shield member. On the other hand, charged particles such as an ion cannot go through the through-hole in the shield member. This can prevent degeneration of a material caused by a chemical reaction between a charged particle and the discharge product removing member, thereby resulting in suppressing a decline in filtration performance of the discharge product removing member.

Further, in the corona discharge device, the through-hole in the shield member is opened toward the discharge product removing member, and the discharge product removing member has a through-hole being opened toward the shield member.

With this structure, discharge products go through the through-hole in the shield member and also go through the through-hole in the discharge product removing member provided in the same direction. Further, it is possible to control the trapping efficiency for discharge products by defining a surface area of the through-hole provided in the discharge product removing member and a thickness of the discharge product removing member.

In the corona discharge device, it is preferable that the discharge product removing member and the shield member are integrated by being made of a single-piece base material.

With the structure, downsizing of the device is possible by reducing the number of the parts. It is also possible to prevent leakage from a boundary surface between the discharge product removing member and the shield member. Further, when each of the members is placed, it is necessary to leave a margin at a boundary between the members to attach them together. A single-piece base material, however, does not need any margins at a boundary between the members. Therefore, it is possible to increase an area for the through-hole in the discharge product removing member and the shield member, thereby resulting in improvement of a filtration function.

Further, in the corona discharge device, it is preferable that the discharge product removing member is made of a plurality of layers of base materials.

To attain the object, a method for making a discharge product removing member is a method for making a discharge product removing member used in the corona discharge device, and the discharge product removing member is formed from a plurality of layers of porous base materials, after each of which is individually coated with a discharge product.

According to the structure, the discharge product removing member has a multilayer construction made of a plurality of layers of discharge product removing base materials. For example, in a case where two types of discharge product removing members are compared, (i) one is a discharge product removing member made of a single-piece discharge product removing base material having T thickness and (ii) the other is a discharge product removing member made of two pieces of discharge product removing base material, each of which has T/2 thickness. The discharge product removing member having T thickness has stronger surface tension because of its thickness and is likely to have clogging. On the other hand, the other discharge product removing member made of two pieces of discharge product removing base material, each of which has T/2 thickness, has a surface tension for T/2 thickness because there is a gap between the base materials, thereby resulting in having less clogging. Accordingly, the other discharge product removing base material can be coated with a discharge product removing material more stably without having a clogging.

In general, smaller through-hole increases a possibility of clogging when a base material is coated with a discharge product removing material. However, it is possible to form a filter with a tiny through-hole without having a clogging by forming a plurality of layers of thin filter base materials, after each of which is coated with a material.

Further, a plurality of discharge product removing materials can be individually provided. For example, two base materials, which are respectively coated with titanic oxide or with manganous oxide, are piled up together for use as filters. This can prevent manganous oxide from a degradation cased by NOx, thereby resulting in a long operational life of each filter.

Further, in the corona discharge device, it is preferable that the discharge product removing member has cells of a honeycomb structure. Specifically, it is preferable that the cells of the honeycomb structure fulfill $T/C \geqq 0.8$ and $(NS)/T \geqq 0.032$, where T is a thickness of the cell (mm), C is a circumference of a cell hole (mm), N is a number of cells (cell/$mm^2$), and S is a cross-sectional area of a cell hole ($mm^2$).

With the above both structures, it is possible to make a cell structure which has high gas conductance and high gas adsorption efficiency, thereby resulting in high trapping efficiency for discharge products.

Further, in the corona discharge device, it is preferable that the through-hole in the shield member has a smaller cross-sectional area than that of the through-hole in the discharge product removing member. Moreover, it is preferable that the through-hole in the shield member has a wavy cross-sectional structure in a thickness direction.

According to the above both structures, it is possible to prevent charged particles such as an ion and an electron, which should be collected at a surface of the shield member, from entering the discharge product removing member side, thereby resulting in a long operational life of the discharge product removing member.

Further, in the corona discharge device, it is preferable that a slit electrode for controlling a voltage between the discharge electrode and the shield member, is provided in an opening section which is located in a surrounding area of the discharge electrode and in which none of the discharge product removing member and the shield member in the surrounding area are provided.

With the structure, it is possible to control a voltage between the discharge electrode and the shield member. This allows controlling the amount of ion supply generated by the discharge electrode.

Further, in the corona discharge device, it is preferable that the corona discharge device includes a discharge electrode extraneous matter removing section in one direction in a surrounding area of the discharge electrode.

With this structure, it is possible to remove extraneous matters accumulated around the discharge electrode periodically, thereby resulting in stabilization of a discharging characteristic of the discharge electrode and a long life of the discharge electrode.

Further, in the corona discharge device, it is preferable that an electric potential difference between the discharge electrode and the shield member is larger than an electric potential difference between the discharge electrode and the slit electrode. Further, it is preferable that another electrode is provided at each of both sides of an opening section, the opening section being in a surrounding area of the discharge electrode and having none of the discharge product removing member, the shield member, and the slit electrode, wherein an electric potential difference is applied between the another electrode. Moreover, it is preferable that an opening section in a surrounding area of the discharge electrode is provided only between the shield member and the slit electrode, and an electric potential difference between the discharge electrode and the shield member is smaller than an electric potential difference between the discharge electrode and the slit electrode.

With the structure, an electric field in which the discharge electrode causes an electric discharge is under control. This allows ion wind to be inducted toward the discharge product removing member side, thereby resulting in more efficient removal of discharge products.

Further, in the corona discharge device, it is preferable that the corona discharge device includes an exhaust air duct in a surrounding area of the discharge product removing member.

With the structure, it is possible to maintain a stable discharging characteristic and improve trapping efficiency for discharge products, without disrupting airflow inside the shield member, in other words, without disrupting electric charge supply to a photoreceptor.

Further, in the corona discharge device, it is preferable that a light source is provided in a surrounding area of the discharge product removing member.

With the structure, it is possible to improve a catalytic reactivity of a photocatalyst component such as titanium oxide by irradiating light from a side of airflow exit via the through-hole in the discharge product removing member. This allows improving a filtration performance.

Further, in the corona discharge device, it is preferable that the material capable of removing discharge products is manganous oxide or titanium oxide.

With this arrangement, ozone and nitrogen oxide which are main components of discharge products can be removed efficiently.

To attain the object, a photoreceptor charger includes a corona discharge device, an airflow block board, which is interposed between the corona discharge device of the present invention and the photoreceptor provided opposing to the corona discharge device, for preventing inflow and outflow of air between the corona discharge device and the photoreceptor.

With the structure, it is possible to prevent airflow in a shear direction generated by a rotation of the photoreceptor from entering and disrupting airflow inside the shield member. Therefore, both stable electric charge supply and high trapping efficiency for discharge products can be achieved.

As described before, the corona discharge device includes a discharge electrode for causing electric discharge, a discharge product removing member containing a material capable of removing discharge products and provided around the discharge electrode, a shield member interposed between the discharge electrode and the discharge product removing member, having a through-hole open toward the discharge electrode, and having a surface opposed to the discharge electrode and, at least the surface being made of a metallic material.

The shield member including the through-hole allows airflow, which was generated in the vicinity of the discharge electrode and reached a surface of the shield member, to guide efficiently and uniformly toward the discharge product removing member, which is provided at the back of the shield member. Therefore, it is possible to provide a corona discharge device which can achieve high trapping efficiency for discharge products and a long life of a discharge product removing filter.

As described above, the photoreceptor charger includes a corona discharge device, an airflow block board, which is provided between the corona discharge device and the photoreceptor provided opposing to the corona discharge, for preventing inflow and outflow of air between the corona discharge device and the photoreceptor.

Further, a method for making a discharge product removing member is a method for making a discharge product removing member used in the corona discharge device, and the discharge product removing member is formed from a plurality of layers of porous base materials, after each of which is individually coated with a discharge product.

Thus, it is possible to provide a photoreceptor charger and a method for making a discharge product removing member which realize high trapping efficiency for discharge products and a long life of a discharge product removing filter.

BRIEF DESCRIPTION OF DRAWINGS

FIG. 1 (*b*) is a cross-section view illustrating flowing directions of ion wind at a shield board and a discharge product removing member in the corona discharge device.

FIG. 15 (*b*) is a cross-section view illustrating an internal structure of the corona discharge device, viewed along line X-X in FIG. 15 (*a*).

FIG. 15 (*c*) is a magnified cross-section view illustrating a shield member in the corona discharge device.

FIG. 17 (*b*) is a cross-section view illustrating a modification example of the conventional corona discharge device.

Figure 1:
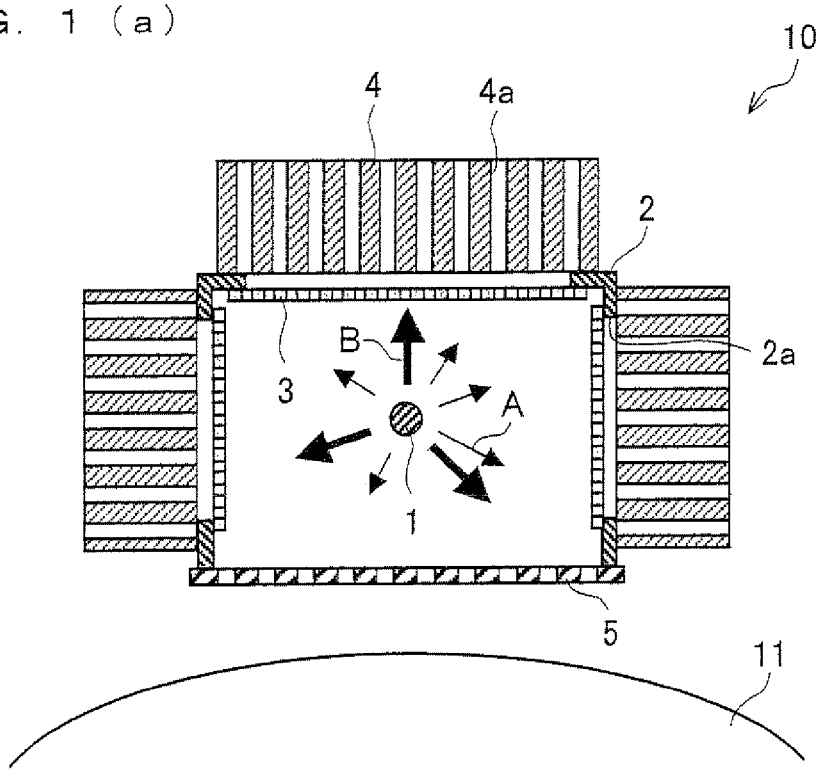
FIG. 1 (*a*) is a magnified cross-section view illustrating an internal structure of a corona discharge device as an embodiment.
Figure 1:
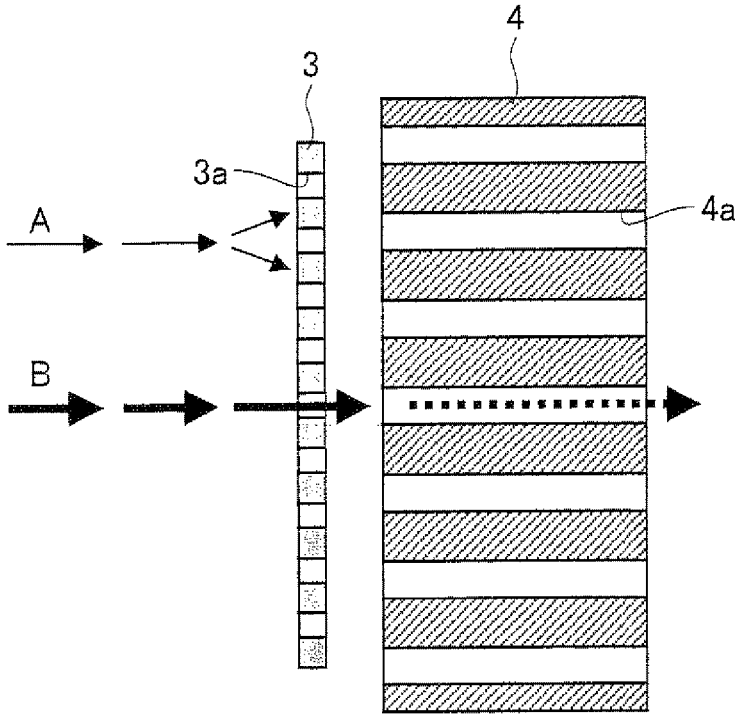

| [Explanation of Reference Numerals] | |
|---|---|
| 1 | Discharge electrode |
| 2 | Filter holder |
| 2a | Opening section |
| 2b | Opening section |
| 3 | Shield board (shield member) |
| 3a | Through-hole |
| 4 | Discharge product removing member |
| 4a | Through-hole |

-continued

| [Explanation of Reference Numerals] | |
|---|---|
| 5 | Grid (slit electrode) |
| 10 | Corona discharge device |
| 11 | Photoreceptor |
| 20 | Corona discharge device |
| 24 | Shield combined discharge product removing member |
| 24a | Conductive section |
| 30 | Corona discharge device |
| 31 | Nitrogen oxide filter (discharge product removing member) |
| 32 | Ozone filter (discharge product removing member) |
| 40 | Corona discharge device |
| 41 | Exhaust air duct |
| 41a | Exhaust port |
| 42 | Airflow block board |
| 43 | Light source |
| 50 | Corona discharge device |
| 51 | Discharge electrode cleaning mechanism (discharge electrode extraneous matters removing section) |
| 52 | Discharge electrode cleaning member |
| 53 | Wrapping paper |
| 55 | Shielding electrode (electrode) |
| 60 | Corona discharge device |
| A | Moving direction of charged particles |
| B | Moving direction of discharge products |
| C | Aspiration direction of ion wind |
| X | Direction of extending a rail |
| Y | Electric potential direction between shield electrodes |
| Z | Electric potential direction between a shield member and a grid member |

BEST MODE FOR CARRYING OUT THE TECHNOLOGY

Embodiment 1

Figure 6:
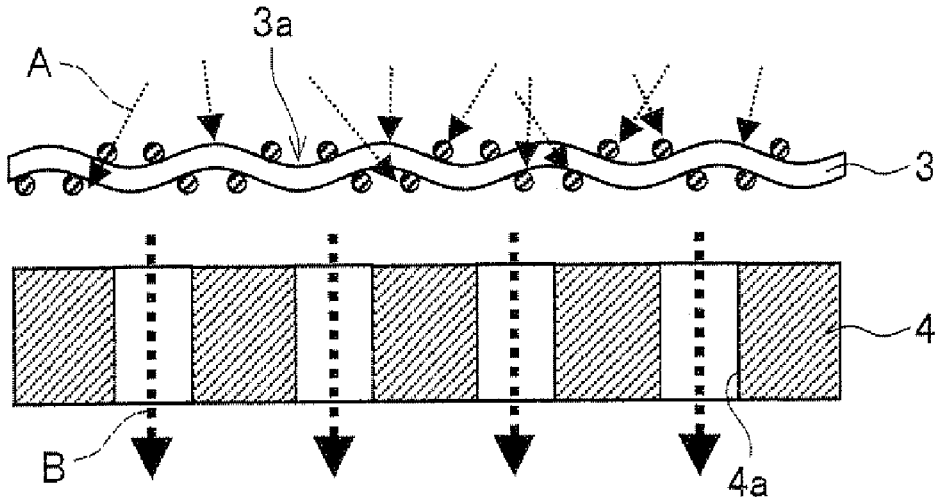
FIG. 6 is a magnified cross-section view illustrating a twilled woven shield board in the corona discharge device.

The following description deals with an embodiment with reference to FIG. 1 (*a*) to FIG. 6. Note that a corona discharge device of the present embodiment is used as a photoreceptor charger for uniform electric charging of a photoreceptor drum and for transferring a toner image formed on the photoreceptor drum to a belt or paper in an electricphotographic copy machine.

Figure 2:
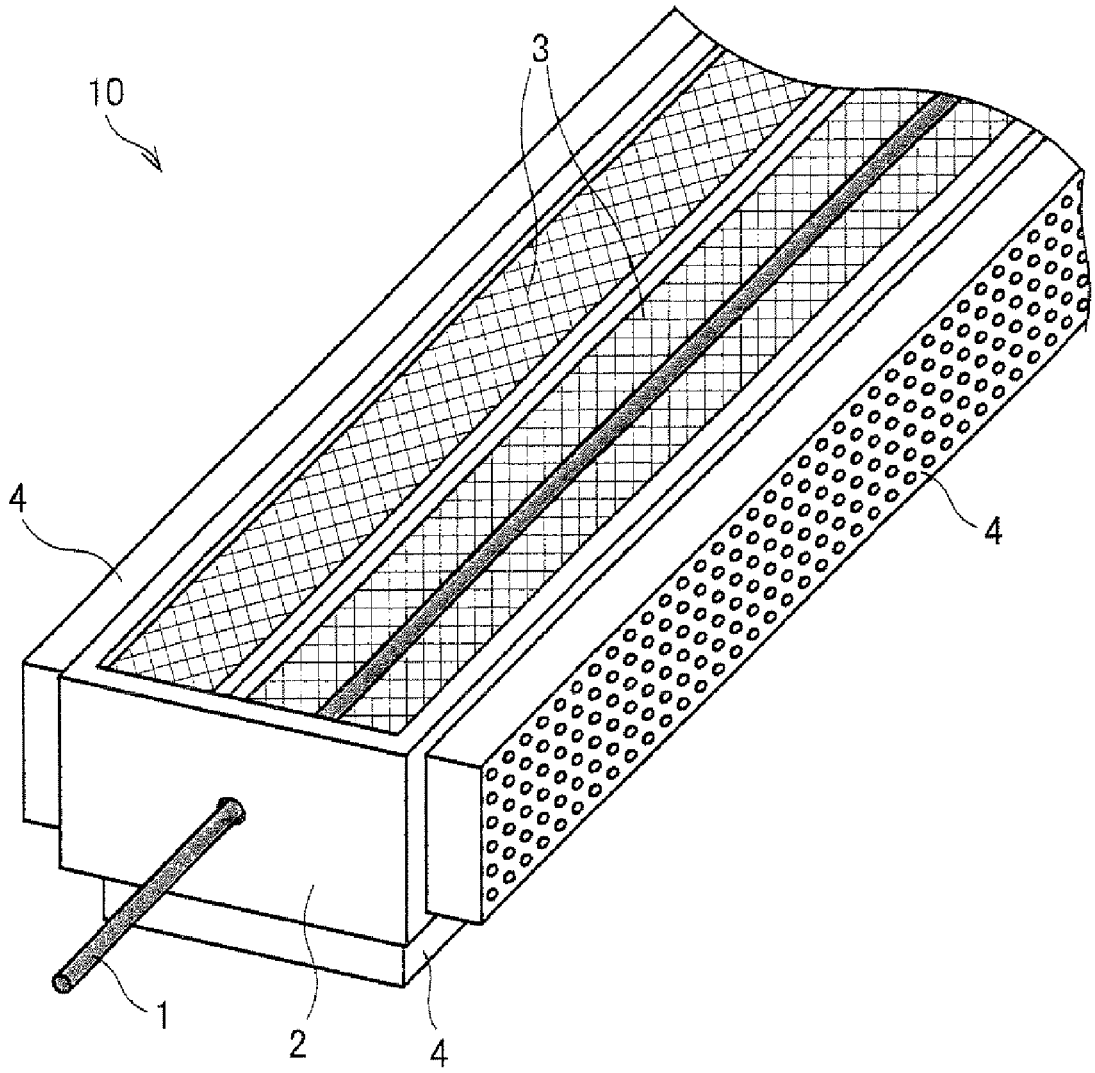
FIG. 2 is a perspective view illustrating the corona discharge device.

A corona discharge device 10 of the present embodiment includes a discharge electrode 1, a filter holder 2, a shield board 3 as a shield member, and a discharge product removing member 4, as illustrated in FIG. 2.

The discharge electrode 1 is a wire electrode having a diameter in a range of 30 μm to 100 μm. This discharge electrode 1 extends between two insulated holders (not illustrated), which are located on both sides of the corona discharge device 10.

The filter holder 2 is a member which has a cross-section that looks like a U shape and is for holding the shield board 3 and the discharge product removing member 4, each of which functions as a filter to be described later. This filter holder 2 is provided around the discharge electrode 1 and is mounted to, for example, a main body of a copy machine which is not illustrated. Also, the filter holder 2, as illustrated in FIG. 1 (*a*), has three walls forming the U shaped cross-section, each of which has a large opening section 2*a*.

The shield board 3 is made of a metallic material. The shield board 3 is provided between the discharge electrode 1 and the filter holder 2 so as to cover the large opening section 2*a* which is formed on each of the three walls of the filter holder 2 that forms the U shaped cross-section. In addition, the shield board 3 has a lot of tiny through-holes 3*a*.

The through-hole 3*a* is a hole which passes through the shield board 3 in a thickness direction, for example, as in a stainless steel punching mesh, or general purpose items such as a plain woven or twilled woven stainless steel mesh, or non-woven fabric. It is preferable that a mesh size of the through-hole 3*a* is in a range of from 0.2 mm to 2 mm.

In the shield board 3, at least one surface opposing to the discharge electrode 1 should be made of a metallic material. A base material of the shield board 3 may be made of an insulating material such as a resin. In this case, it is necessary to provide a metallic material, by plating or deposition, on the surface opposing to the discharge electrode 1. The thus coated metallic material opposing to the discharging electrode 1 is connected to a high-voltage power supply, so that voltage control of the metallic material can be controlled independently from the discharge electrode 1.

The discharge product removing member 4 is provided so as to externally cover the large opening section 2*a* which is formed on the three walls of the filter folder 2 that forms the U shaped cross-section. Also, the discharge product removing member 4 has a lot of through-holes 4*a*.

The through-hole 4*a* is formed open toward the shield board 3. It is preferable that a mesh size of the through-hole 4*a* is in a range of from 0.2 mm to 2 mm.

On entire surface of the discharge product removing member 4, a discharge product removing material is provided, the entire surface including an internal surface of the through-hole 4*a*. A main component of the discharge product removing material for removing ozone is manganous oxide, and a main component of the discharge product removing material for removing nitrogen oxide is titanium oxide. Besides each main component, the discharge product removing material may further contain an activated carbon; a metal or metallic oxide such as lead dioxide, palladium, platinum, nickel, rhodium, or the like; a silicon-based binder resin; a solvent; or the like.

A base material of the discharge product removing member 4 including a through-hole 4*a* in a thickness direction should have a heat resistance against a baking temperature or a higher temperature when the discharge product removing material is backed. For example, aluminum or paper having through-holes of a honeycomb structure, or a punched material made of stainless steel or ceramic is preferable.

On an opening side of the U shaped cross-section in the filter holder 2, a grid 5 made of stainless steel is provided. The grid 5 is for controlling the amount of ion supply generated at the discharge electrode 1.

In the corona discharge device 10 of the present embodiment, the opening side of the U shaped cross-section in the filter holder 2, is arranged so as to face a photoreceptor 11.

The following description deals with a flow of an ion and discharge products, both of which are generated during a corona discharge performed by the corona discharge device 10 with the above arrangement, with reference to FIG. 1 (*a*) and FIG. 1 (*b*).

As illustrated in FIG. 1 (*a*), application of a high voltage ranging from 3 kV to 5 kV to the discharge electrode 1 causes a corona discharge around the discharge electrode 1. As a result, charged particles such as an ion and an electron are generated due to an ionization of a neutral molecule in the air. Further, ozone is generated by a collision of an oxygen molecule and an oxygen atom, which was dissociated in an electric discharging area; and nitrogen oxide such as NO and $NO_2$ is generated by a collision between an oxygen atom and a nitrogen atom or a nitrogen molecule.

As illustrated in FIG. 1 (*b*), the charged particles thus generated move in a substantially radial pattern, as indicated by arrows A, in directions of an electric field generated by an electric potential gradient between the shield board 3 and the discharge electrode 1 which is applied a high voltage. By receiving electric field power, the charged particles reach the shield board 3, which is a counter electrode of the discharge electrode 1, and are finally collected. At the same time, the charged particles go through the grid 5 illustrated in FIG. 1 (*a*) and attach to the photoreceptor 11 so that the photoreceptor 11 is charged.

On the other hand, discharge products such as ozone and nitrogen oxide start being spread out as ion wind in directions substantially the same as moving directions of charged particles, as indicated by arrows B. When the ion wind reach the shield board 3, the ion wind maintain the direction of spreading-out and go through the through-hole 3*a* in the shield board 3 and the through-hole 4*a* in the discharge product removing member 4, because the ion wind is not attracted to the electric field like charged particles. Then, the discharge products are collected and removed due to a catalysis action of the discharge product removing material with which the discharge products contact while they go through the through-hole 4*a*.

As described above, with the structure, charged particles, which are generated during an electric discharge, are collected when they reach the shield board and are not able to reach the discharge product removing member 4. On the other hand, only discharge products can smoothly go through the through-hole 3*a* in the shield board 3 and the through-hole 4*a* on which a discharge product removing material is formed, without changing a spreading direction. Therefore, it is possible to collect and remove discharge products highly efficiently.

Table 1 shows comparison results of ozone trapping efficiencies when a corona discharge is actually performed by a corona discharge device with the present structure.

In experiments, a plain woven stainless steel mesh having a mesh size 650 μm was used as the shield board 3 having the through-hole 3*a*. An ozone filter having 6 mm thickness and 400 cell/inch honeycomb structure was used as the discharge product removing member 4. Then, it was able to reduce the amount of ozone 1/500 by inducing ion wind to a through-hole 4*a* in the ozone filter after going through the stainless steel mesh efficiently. It is also possible to achieve about 250 times of ozone trapping efficiency compared to a case where the shield board 3 has a surface formed with manganous oxide, as described in the conventional example.

TABLE 1

| Structure | Manganous oxide | Ozone Residual volume (relative value) | Ozone trapping efficiency (relative value) |
|---|---|---|---|
| Shield: without holes | N/A | 1 | 1 |
| Shield: without holes | carried on its surface | ½ | 2 |
| Shield: with holes Filter: with holes | carried inside a through-hole of the filter | 1/500 | 500 |

Table 2 shows comparison results of the discharge product removing member 4 in two different base structures and their performances.

There are two types of base structures, a honeycomb structure and a mesh structure, each of which shows a different performance. In order to efficiently collect and remove discharge products, high air permeability is necessary. Compared to the mesh structure, the honeycomb structure is capable of forming a structural object which has higher opening ratio in condition of having increased thickness. Therefore, the honeycomb structure is the most suitable structure to suppress an increase in flow resistance of gas.

TABLE 2

| Base material | Opening ratio | Thickness |
|---|---|---|
| Honeycomb structure | About 77% at most | 4 mm or more |
| Mesh structure | About 66% at most | 3 mm at most |

The following description deals with a relation of the number of mesh, size of a through-hole, thickness, and ozone trapping efficiency, in a case where the discharge product removing member 4 has a honeycomb structure.

Gas adsorption efficiency and gas conductance of through-holes of a honeycomb structure is expressed by the following Equations (1) and (2):

$$Ea=(\alpha T)/C \quad (1)$$

$$Cf=(\beta NS)/T \quad (2)$$

wherein Ea is gas adsorption efficiency of through-holes of a honeycomb structure; Cf is gas conductance; N is the number of mesh holes; C is a through-hole size (circumference of a through-hole); S is a through-hole size (cross-sectional area of a through-hole); T is thickness; and $\alpha$ and $\beta$ are constants depending on gases and coating materials.

Figure 3:
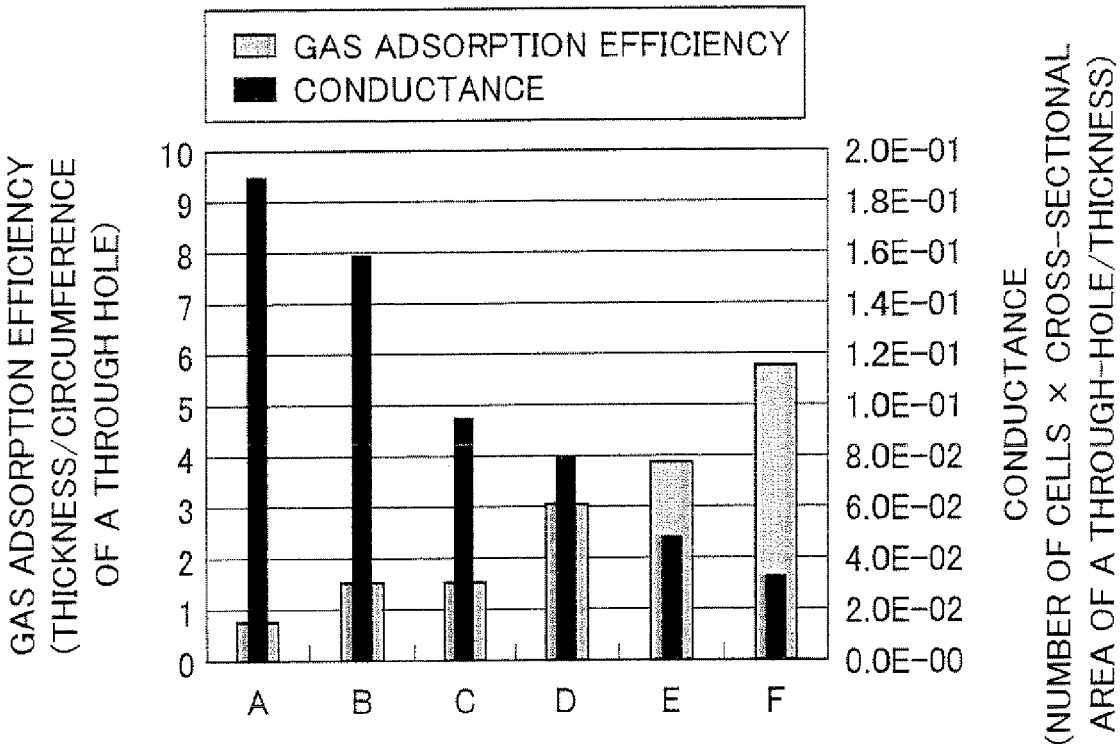
FIG. 3 is a graph showing a correlation between gas adsorption efficiency of the discharge product removing member and gas conductance of the discharge product removing member in the corona discharge device.

FIG. 3 shows calculation results of relative values between gas adsorption efficiency and gas conductance in samples A through F as a discharge product removing member 4 having a honeycomb structure based on Equations (1) and (2). As shown in FIG. 3, gas adsorption efficiency and gas conductance are contrary to each other. For example, in a case where gas adsorption efficiency is increased by reducing through-hole sizes such as circumference and cross-sectional area, flow resistance of gas of a through-hole increases and gas conductance, which has an inverse number of the flow resistance of gas, decreases.

Figure 4:
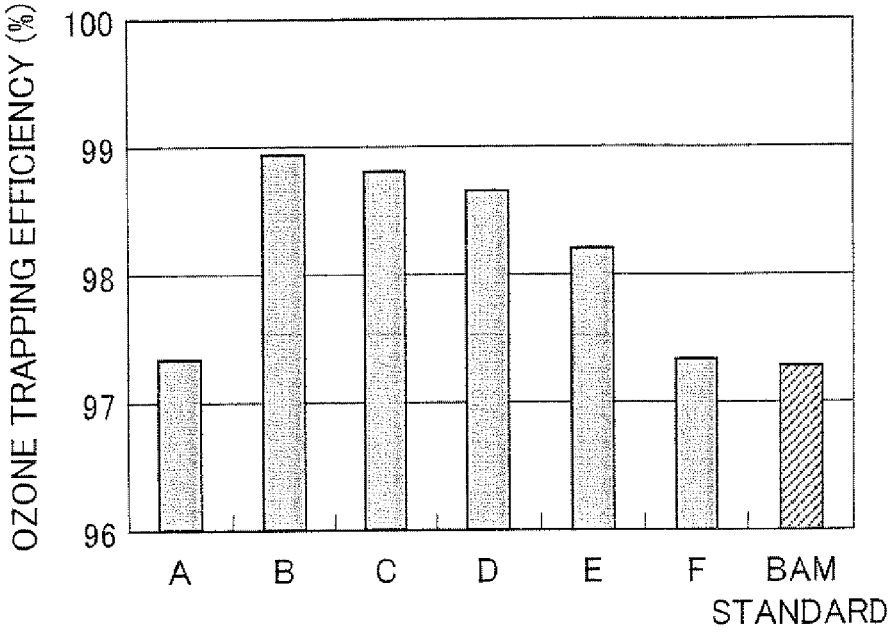
FIG. 4 is a graph showing ozone trapping efficiency of the discharge product removing member of the corona discharge device.

According to measurement results of the amount of ozone collected by the samples A through F, FIG. 4 shows an ozone trapping efficiency of each of the samples A through F. As shown in FIG. 4, the sample B has the highest ozone trapping efficiency. Accordingly, when the ozone trapping efficiency is the highest, a relative value (T/C) without multiplying the fixed number $\alpha$ is 1.5 in the Equation (1) that shows gas adsorption efficiency, and a relative value (NS/T) without multiplying the fixed number $\beta$ is 0.158 in Equation (2) that shows gas conductance.

Comparing between the BAM standard for regulating the generation amount of ozone and the trapping efficiency of each of the six samples A through F, it is preferable that a relative value (T/C) of gas adsorption rate is 0.8 or more, and a relative value (NS/T) of gas conductance is 0.032 or more.

As shown in the conventional example, in a case where the discharge product removing member is exposed to ion wind all the time inside the shield board during a corona discharge, charged particles such as an ion come into a surface of the discharge product removing member. This causes a chemical reaction other than the catalyst action, thereby proceeding deterioration of the discharge product removing member.

With the structure, however, the shield board 3 is provided between the discharge product removing member 4 and the discharge electrode 1 so as to collect charged particles by an electric field. This prevents charged particles from entering the discharge product removing member 4 side. Therefore, it is possible to slow down the deterioration of the discharge product removing member and significantly reduce degradation in removal performance of discharge products.

Table 3 shows measurement results of a relation between (i) discoloration of an ozone filter and (ii) with and without a stainless steel mesh as the shield board 3 interposed between the discharge product removing member 4 and the discharge electrode 1. Without the stainless steel mesh, charged particles such as an ion and an electron reach a surface of the ozone filter directly. Therefore, on the surface of the ozone filter, a chemical reaction other than the catalyst action occurs and causes discoloration of the ozone filter in about 5-hour electric discharge. In a case of being shielded with the stainless steel mesh, however, charged particles are collected on a surface of the stainless steel mesh due to an electric field. Therefore, charged particles do not reach the surface of the ozone filter and no discoloration can be seen in the ozone filter.

TABLE 3

| Structure | Discoloration of Ozone filter |
|---|---|
| Without shield | Discoloration occurred in 5-hour electric discharge |
| With shield | No discoloration occurred |

Figure 5:
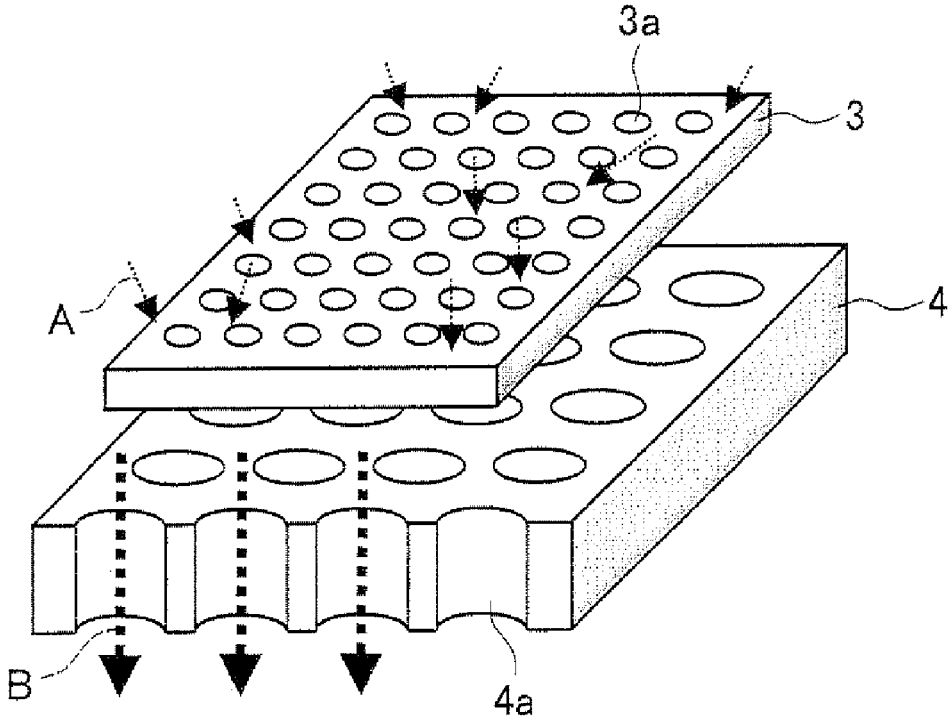
FIG. 5 is a perspective view illustrating an internal structure of the corona discharge device.

In the present embodiment, as described above, a mesh size of the through-hole 3*a* in the shield board 3 ranges from 0.2 mm to 2 mm, and a mesh size of the through-hole 4*a* in the discharge product removing member 4 is in a range of from 0.2 mm to 2 mm. However, in view of preventing charged particles from entering the discharge product removing member 4, as illustrated in FIG. 5, it is preferable that a cross-sectional area of the through-hole 3*a* in the shield board 3 is smaller than a cross-sectional area of the through-hole 4*a* in the discharge product removing member 4.

According to the above explanation, the shield board 3 has a simple through-hole 3*a* by using a stainless steel punching mesh. However, the shield board is not specifically limited to this. For example, a plain woven or twilled woven stainless steel mesh having a curved cross-sectional structure in a thickness direction, as illustrated in FIG. 6, may be available. It is preferable that the curved line is a wavy line. Note that FIG. 6 shows double twilled woven stainless steel mesh.

Further, as above described, one electrode is used as the discharge electrode 1, however, it is not limited to this. For example, the discharge electrode may be a comb electrode, a board electrode, or a plurality of discharge electrodes 1.

Embodiment 2

Figure 7:
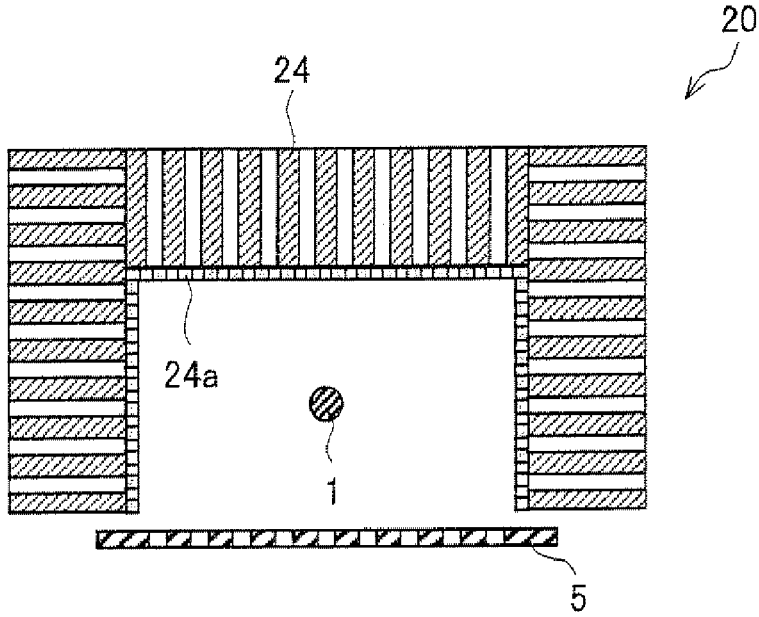
FIG. 7 is a cross-section view illustrating another embodiment of a corona discharge device.

The following description deals with another embodiment with reference to FIG. 7. A structure not described in the following explanation is the same as the embodiment 1. For the sake of convenience in explanation, a member which has the same function of a member illustrated in drawings of the embodiment 1, has the same reference number and its explanation is omitted.

The corona discharge device 10 as the embodiment 1, includes three members such as the filter holder 2 which has a cross-section that looks like a U shape, the shield board 3, and the discharge product removing member 4 which has a cross-section that looks like a U shape.

In embodiment 2, however, a corona discharge device 20 includes a shield-integrated discharge product removing member 24 which is made of a single-piece base material integrally constituting a discharge product removing member 4 and a shield board 3 with a U shaped cross-section, as illustrated in FIG. 7.

The shield-integrated discharge product removing member 24 is constructed by adhesion of three pieces of aluminum base materials, each of which has a conductive section 24*a* on a surface that is not coated with a discharge product removing material and functions as a shield, so as to form a square U shaped cross-section internally having the conductive section 24*a* entirely.

Namely, the aluminum base material entirely has through-holes of a honeycomb structure. While one side of the through-holes is sealed, a coating of a discharge product removing material is carried out to the other side. As a result, only that side of through-holes which were sealed in the coating process has an aluminum exposed surface which functions as the conductive section 24*a*.

As the corona discharge device 20 of the present embodiment, with use of an aluminum base material having through-holes of a honeycomb structure, it is possible to form the shield-integrated discharge product removing member 24 which has an internal surface formed with the conductive section 24*a* as a shield section.

In addition, this structure allows omitting the filter holder 2 which is used in the corona discharge device 10 as the embodiment 1. Therefore, downsizing of the device is possible by a reduction of the number of parts. In the present embodiment, the shield combined discharge product removing member 24 is mounted in a main body of a copy machine (not-illustrated).

In the embodiment 1, there is a possibility of leakage from a boundary between the shield board 3 and the discharge product removing member 4. However, a corona discharge device made of a single-piece base material as the present embodiment is free from the leakage from a boundary between the shield board 3 and the discharge product removing member 4, thereby resulting in high trapping efficiency for discharge products.

In addition, this structure does not need a margin at a boundary between members. This allows increasing an area for the through-hole 3*a* in the shield board 3 and the through-hole 4*a* in the discharge product removing member 4, thereby resulting in further improvement of a filtration function.

In the present embodiment, a conductive base material, which is made of aluminum and the like, is coated with a discharge product removing material except the conductive section 24*a*. However, it is not specifically limited to this. For example an insulated base material (such as paper) in a honeycomb structure may be coated with a discharge product removing material, and one side of the base material facing the discharge electrode 1 may be plated or deposited so as to form the conductive section 24*a*.

Embodiment 3

Figure 8:
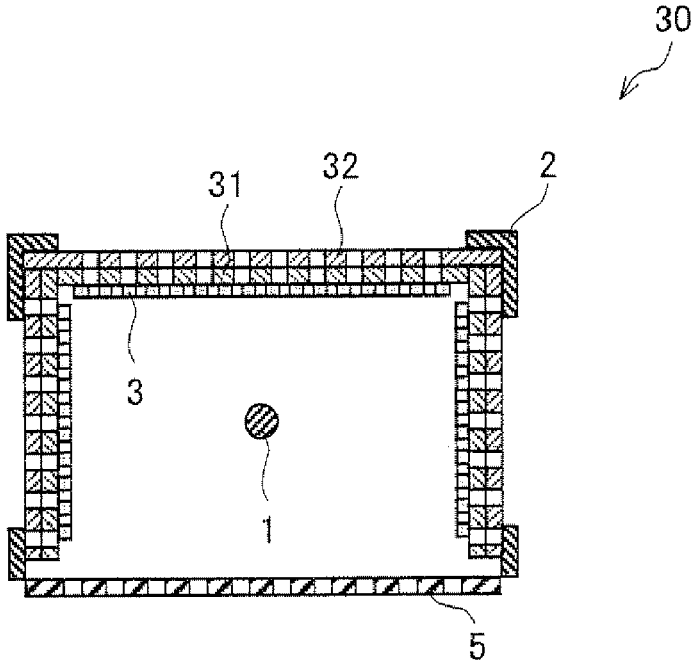
FIG. 8 is a cross-section view illustrating further another embodiment of a corona discharge device.

The following description deals with further another embodiment with reference to FIG. 8. A structure not described in the following explanation is the same as the embodiments 1 or 2. For the sake of convenience in explanation, a member, which has the same function of a member illustrated in drawings of the embodiments 1 or 2, has the same reference number and its explanation is omitted.

The corona discharge device 20 as the embodiment 2 includes the shield-integrated discharge product removing member 24 which is made of a single-piece base material and has a cross-section that looks like a square U shape.

A corona discharge device 30 of the present embodiment 3, however, includes a plurality of layers of stainless steel meshes as a single-piece, as illustrated in FIG. 8.

Specifically, in the corona discharge device 30 of the present embodiment, as illustrated in FIG. 8, a shield board 3 which is made of a stainless steel mesh and is provided at the most internal surface exposing to the discharge electrode 1, a nitrogen oxide filter 31 as a discharge product removing member coated with titanium oxide, and an ozone filter 32 as a discharge product removing member coated with manganous oxide are arranged in this order. Each of the nitrogen oxide filter 31 and ozone filter 32 is also made of a stainless-steel mesh. Therefore, the whole structure is a single-piece made of a plurality of layers of stainless steel meshes.

In a case of forming a plurality of layers of stainless steel meshes, a stainless steel mesh with no coating is provided as the shield board 3 at the most internal surface exposing to the discharge electrode 1, and then a stainless steel mesh coated with a discharge product removing material such as the nitrogen oxide filter 31 or the ozone filter 32 is provided in a direction of airflow passing through.

As the corona discharge device 30 of the present embodiment, it is possible to form a base material coated with a discharge product removing material smoothly without occurring a clogging, from a plurality of layers of thin filters such as a stainless steel mesh. Namely, when a base material is coated with a discharge product removing material in a method of dip coating and the like, the base material is more likely to have a clogging as increasing a thickness of the base material and as reducing a through-hole size. However, it is possible to form a filter with a tiny through-hole without having a clogging in such a manner that each of the thin filter base materials is individually coated with a discharge product removing material and then pile them up together, because each of the base material is thin enough for smooth coating.

In the corona discharge device 30, a plurality of discharge product removing materials are not mixed together, but a plurality of stainless steel meshes coated with each different discharge product removing material are used by piling them up together. Specifically, the nitrogen oxide filter 31 coated with titanium oxide and the ozone filter 32 coated with manganous oxide are arranged in this order from inside to outside. Manganous oxide is degenerated by nitrogen oxide, which causes decline in ozone trapping efficiency. However, with the arrangement, nitrogen oxide is removed at first so that nitrogen oxide is not allowed passing through the ozone filter 32. This prevents decline in the trapping efficiency of the ozone filter 32, and prolongs its filtration function. Namely, it is possible to form an adequate filter structure with ease and improve the filtration function.

Embodiment 4

Figure 9:
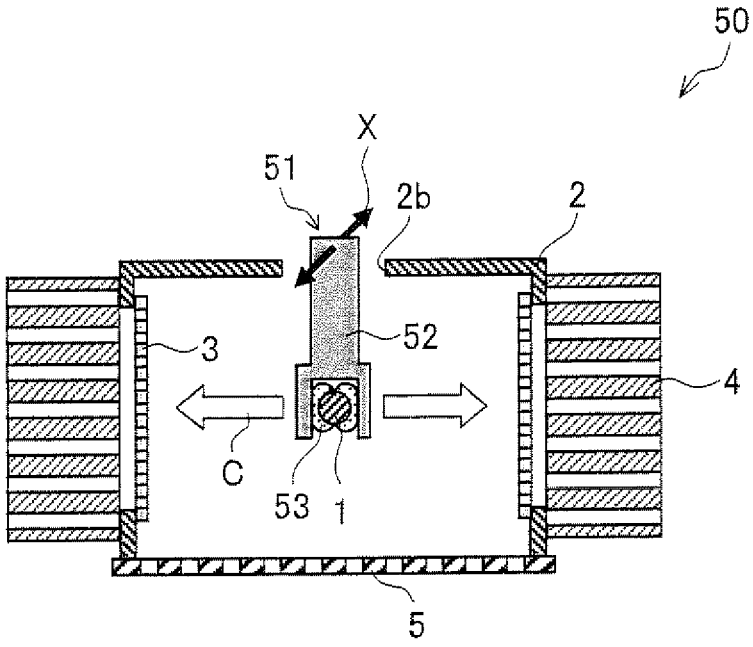
FIG. 9 is a cross-section view illustrating still further another embodiment of a corona discharge device.
Figure 13:
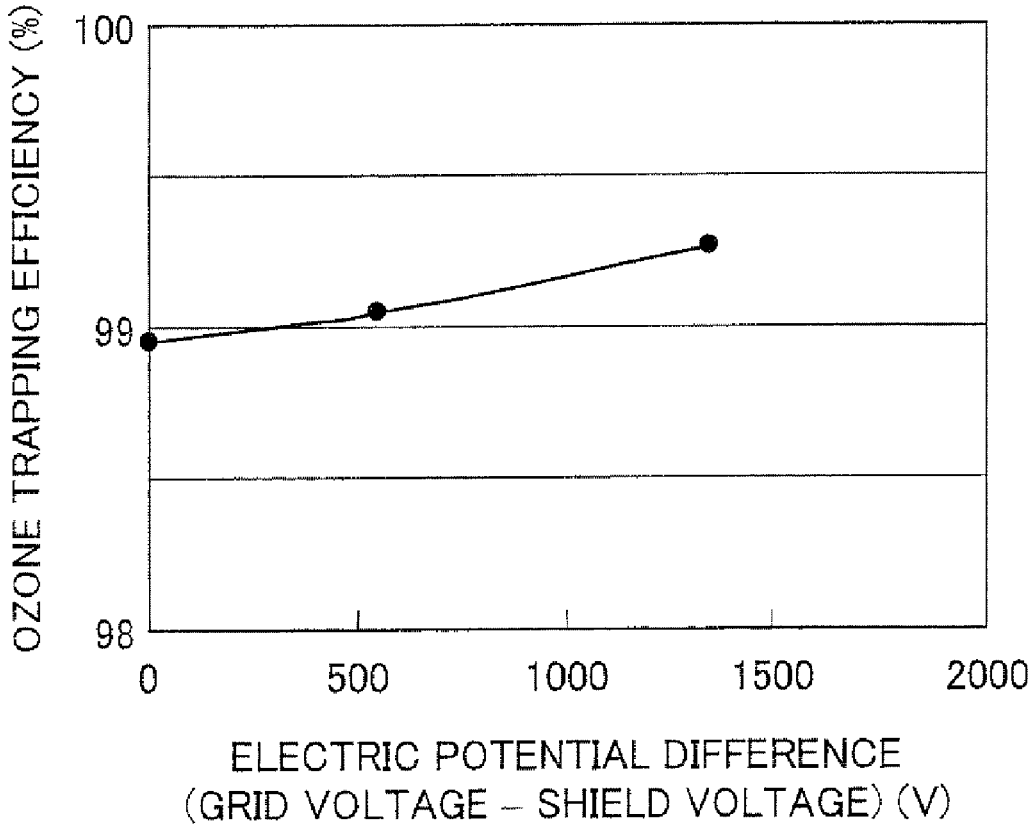
FIG. 13 is a graph showing a relation between ozone trapping efficiency and electric potential difference in grid-shield members in the corona discharge device.

The following description deals with a still further embodiment with reference to FIG. 9 and FIG. 13. A structure not described in the following explanation is the same as the embodiments 1 through 3. For the sake of convenience in explanation, a member, which has the same function of a member illustrated in drawings of the embodiments 1 through 3, has the same reference number and its explanation is omitted.

In the corona discharge devices as the embodiments 1 through 3, three sides out of four sides around a discharge electrode 1 are made of a shield member 3 and a discharge product removing member 4.

A corona discharge device 50 of the present embodiment 4, however, on one side opposing to a grid 5 (called back side hereinafter), an opening section 2*b* of a filter holder 2 is provided without having the shield member 3 and the discharge product removing member 4. In the opening section 2*b* of the filter holder 2, a discharge electrode cleaning mechanism 51 is provided.

The discharge electrode cleaning mechanism 51 includes a rail (not-illustrated) extending in a direction X in which a discharge electrode 1 is extended on the backside of the corona discharge device 50, a discharge electrode cleaning member 52 provided on the rail, and a driving motor (not-illustrated) for moving the discharge electrode cleaning member 52. The discharge electrode cleaning member 52 is moved back and forth on the rail by the driving motor periodically.

In a distal end of the discharge electrode cleaning member 52, a fibrous or a small grain size wrapping paper 53 is provided so as to clean and grind a surface of the discharge electrode 1 by contacting and sandwiching the discharge electrode 1 from both sides.

According to the structure, the discharge electrode cleaning member 52 provided inside the discharge electrode cleaning mechanism 51 periodically moves back and forth so that the wrapping paper 53 can remove extraneous matters accumulated around the discharge electrode 1. This allows realizing stabilization of a discharging characteristic of the discharge electrode 1 and a long life of its operation life.

On the backside of the corona discharge device 50, the opening section 2*b* in the filter holder 2 is provided for inserting the discharge electrode cleaning mechanism 51. In order to prevent leakage of discharge products from the opening section 2*b* in the filter holder 2, an electric potential condition of the shield member 3 is controlled.

Figure 10:
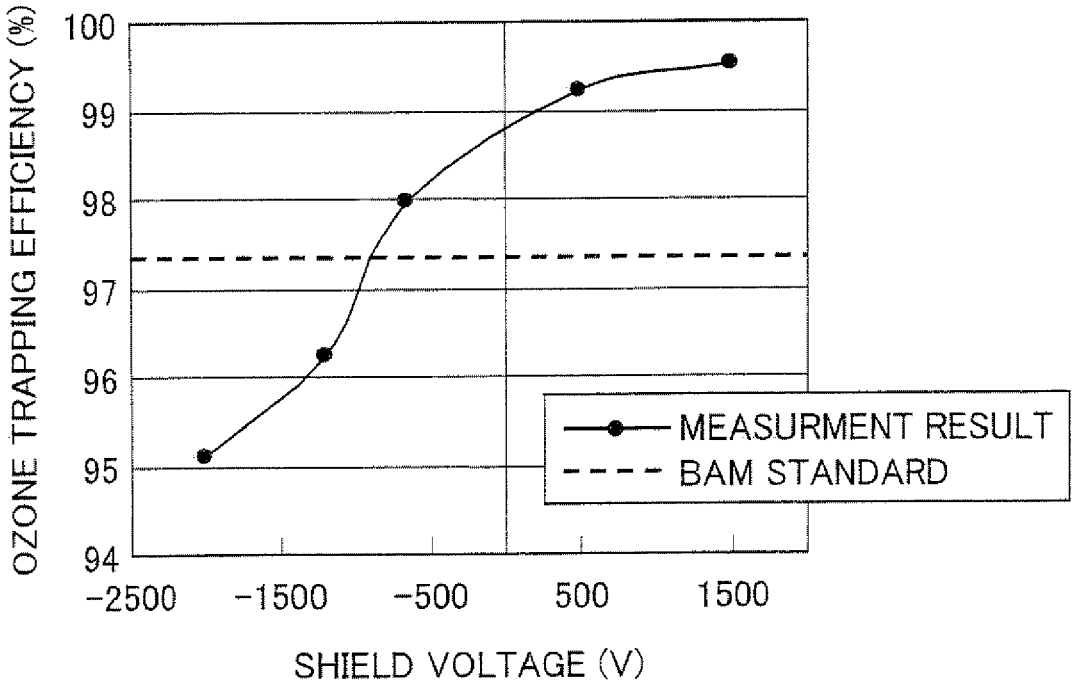
FIG. 10 is a graph showing a relation between electric potential of a shield member and ozone trapping efficiency in the corona discharge device.

FIG. 10 shows measurement results how the leakage of discharge products from the opening section 2*b* in the filter folder 2 was prevented. FIG. 10 shows a relation between an electric potential of the shield member 3 and ozone trapping efficiency of the corona discharge device 50 as the embodiment 4. It is possible to improve the ozone trapping efficiency by increasing the electric potential of the shield member 3 in directions of ion wind aspiration indicated by arrows C in FIG. 9.

Compared to the BAM standard for the generation amount of ozone, the corona discharge device 50 of the present embodiment 4 can achieve the ozone trapping efficiency higher than the value of the BAM standard in such a manner that a voltage of the shield member 3 is set to be larger than a voltage of the grid 5.

Figure 11:
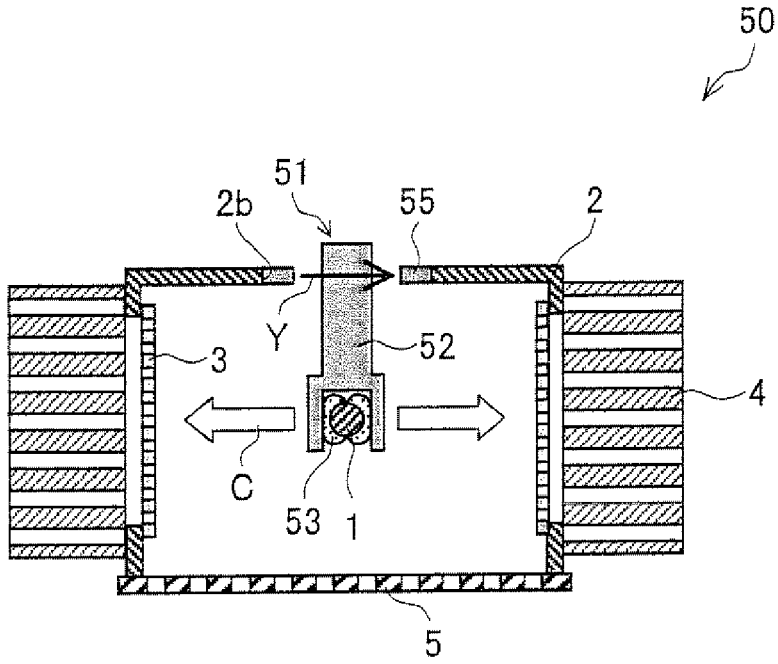
FIG. 11 is a cross-section view illustrating a modification example of the corona discharge device.

As illustrated in FIG. 11, an independent shield electrode 55 may be provided at both ends of the opening section 2*b* in the filter holder 2. It is possible to prevent ion wind from flowing out through the opening section 2*b* in the filter holder 2 by applying an electric potential difference Y between the shield electrodes 55. This allows preventing leakage of discharge products.

Figure 12:
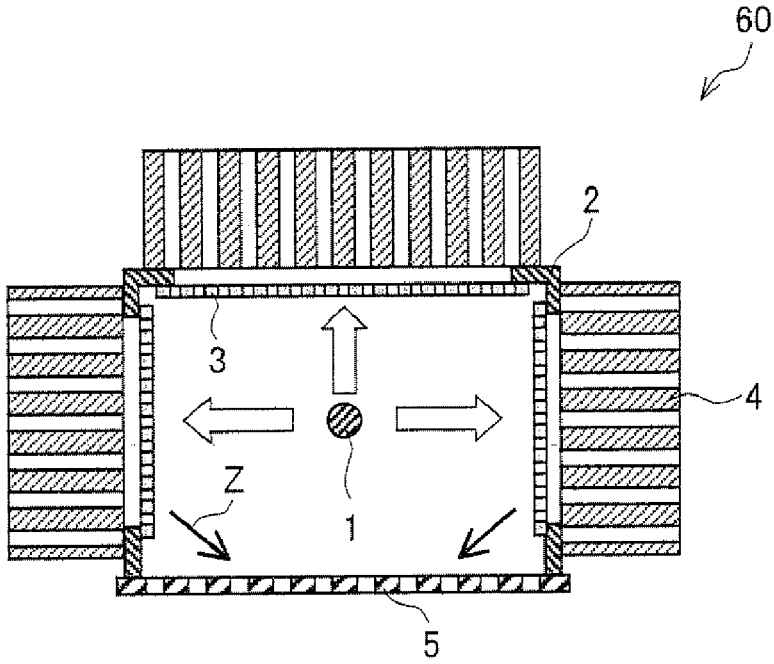
FIG. 12 is a cross-section view illustrating yet another embodiment of a corona discharge device.

The following description deals with a corona discharge device 60 in which the discharge electrode 1 surrounded by four sides in which three sides are shieldly connected one another as illustrated in FIG. 12. At the only one opening section between a shield member 3 and a grid 5, electric potential difference Z is applied so that an electric potential of the grid 5 is larger than that of the shield member 3. It is possible to prevent leakage of ion wind and improve ozone trapping efficiency by increasing the electric potential difference Z, as shown in FIG. 13.

Embodiment 5

Figure 14:
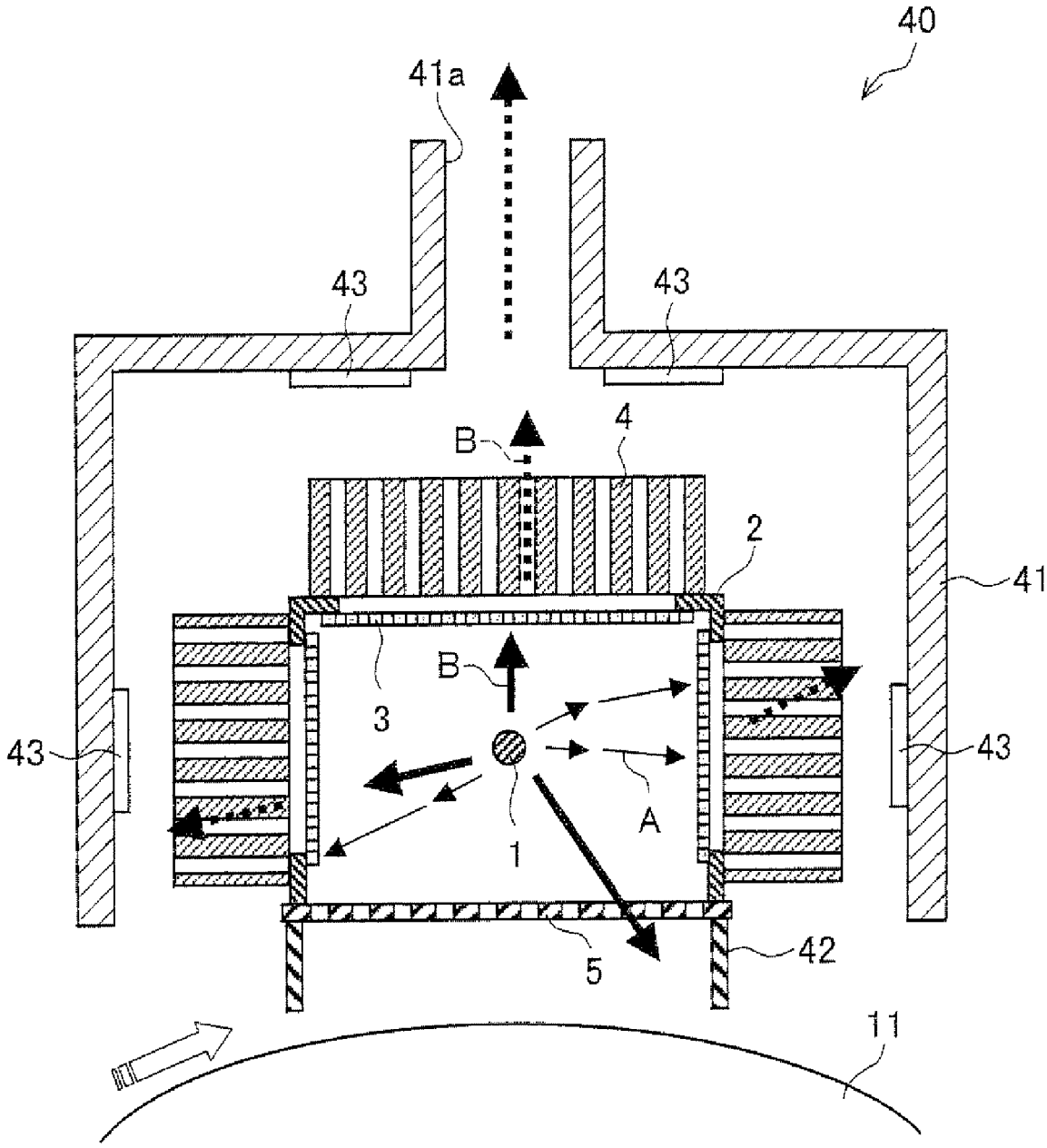
FIG. 14 is a cross-section view illustrating still yet another embodiment of a corona discharge device.
Figure 15:
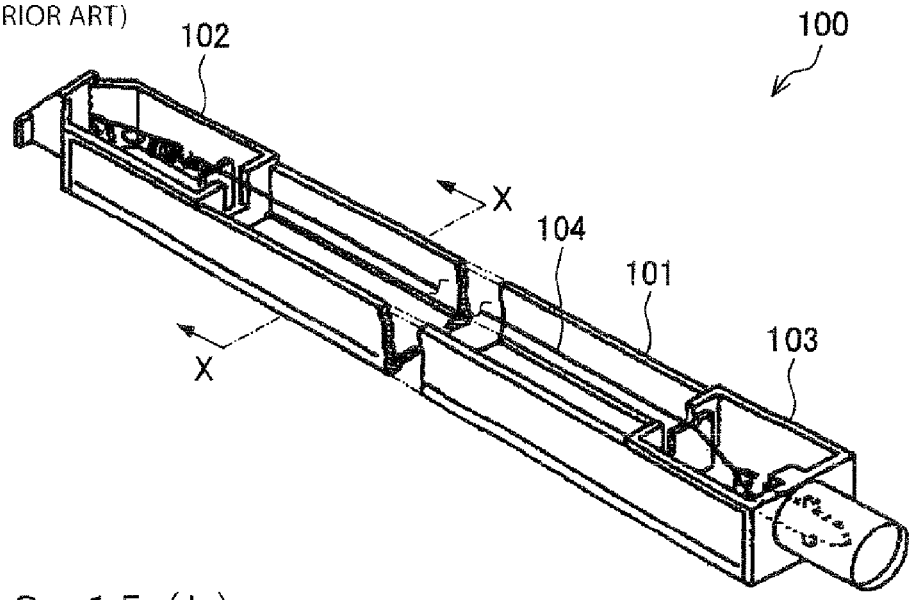
FIG. 15 (a) (PRIOR ART)
FIG. 15 (*a*) is a perspective view illustrating a conventional corona discharge device.
Figure 15:
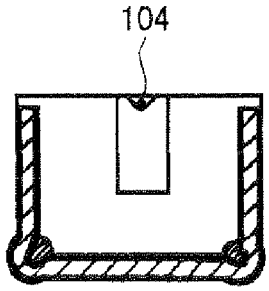
FIG. 15 (b) (PRIOR ART)
Figure 15:
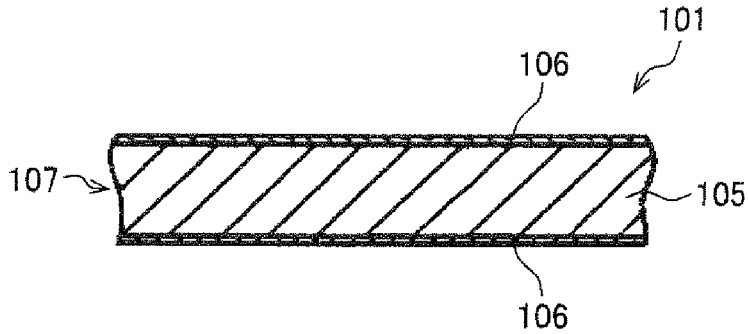
FIG. 15 (c) (PRIOR ART)
Figure 16:
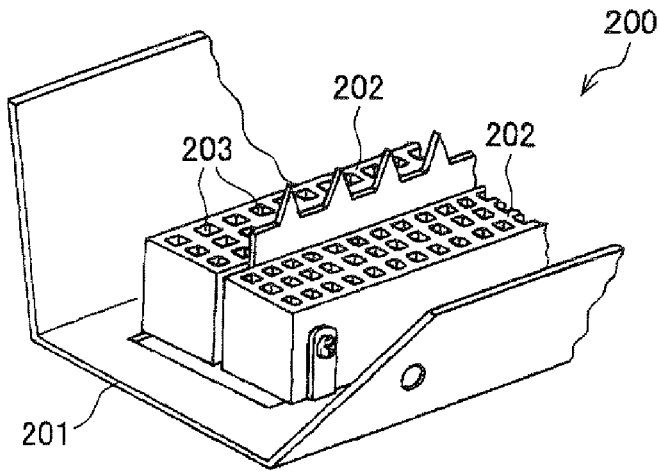
FIG. 16 (PRIOR ART)
FIG. 16 is a perspective overview illustrating another embodiment of a conventional corona discharge device.
Figure 17:
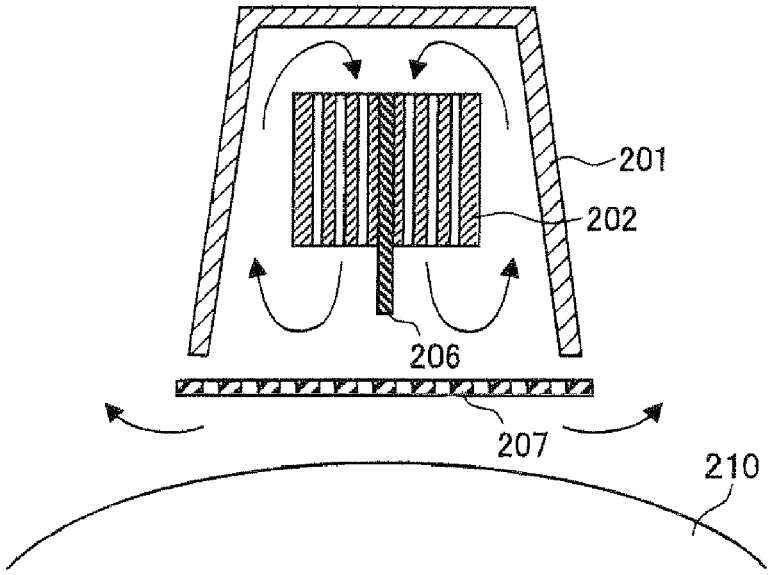
FIG. 17 (a) (PRIOR ART)
FIG. 17 (*a*) is a cross-section view illustrating the conventional corona discharge device.
Figure 17:
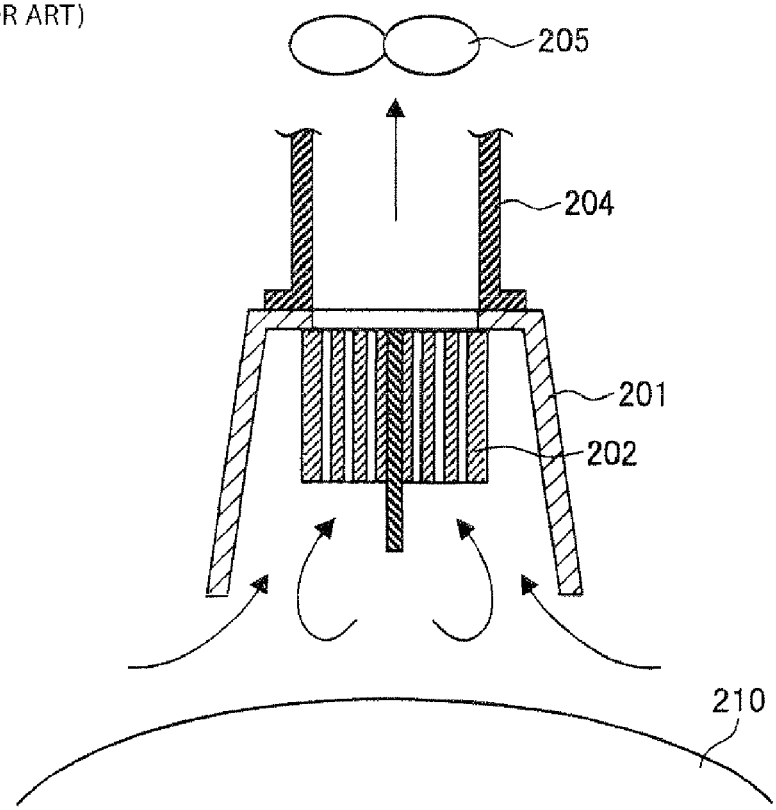
FIG. 17 (b) (PRIOR ART)

The following description deals with still yet another embodiment with reference to FIG. 14. A structure not described in the following explanation is the same as the embodiments 1 through 4. For the sake of convenience in explanation, a member, which has the same function of a member illustrated in drawings of the embodiments 1 through 4, has the same reference number and its explanation is omitted.

In embodiment 1, the through-hole 3*a* in the shield board 3 and the through-hole 4*a* in the discharge product removing member 4 are provided in this order in a direction of airflow generated by an electric discharge, so as to remove discharge products.

Compared to the embodiment 1, a corona discharge device 40 as an embodiment 5 further includes an exhaust air duct 41 and an airflow block board 42 as illustrated in FIG. 14.

The exhaust air duct 41 is provided so as to entirely surround a discharge product removing member 4. Also, the exhaust air duct 41 is designed so that a cross-sectional area of fluid-channel inside the exhaust air duct 41 is substantially uniform. At a part of the exhaust air duct 41, an exhaust port 41*a* is provided. In the downstream of the exhaust port 41*a*, a fan is provided for controlling exhaustion.

The airflow block board 42 is provided at both ends of a grid 5 and attached to a filter holder 2. The airflow block board 42 may be projected toward a photoreceptor 11 side than the grid 5. Alternatively, the airflow block board 42 may contact the photoreceptor 11 and a low frictional material may be provided on a contact surface.

By providing the exhaust air duct 41 which uniformly surrounds the discharge product removing member 4 as in the corona discharge device 40 of the present embodiment, it is possible to release airflow uniformly from the discharge product removing member 4.

At the both ends of the grid 5, the airflow block board 42 is provided. The airflow block board 42 provided at upstream of a rotation direction of the photoreceptor 11 can prevent inflow of a shear flow from the outside, while the photoreceptor 11 rotates. Namely, it is possible to prevent the inflow of air between the photoreceptor 11 and the grid 5.

Further, the airflow block board 42 provided at downstream of the rotation direction of the photoreceptor 11 can prevent outflow of ion wind inside the corona discharge device 40 through the grid 5.

In the corona discharge device 40, a through-hole 3*a* in a shield board 3 and a through-hole 4*a* in a discharge product removing member 4 are provided in a direction in which ion wind flows inside a discharging area. Further, the airflow block board 42 can prevent the inflow and outflow of air at the grid 5 side. Therefore, the ion wind inside the discharging area is not extremely disturbed by the inflow of air from the photoreceptor 11 side, even though the ion wind inside the corona discharge device 40 is released to the outside, thereby resulting in a stable exhaust. Also variations in the amount of electric discharge caused by uneven exhaust are reduced, thereby resulting in a stable electric charge supply.

Further, in the corona discharge device 40, a light source 43 may be provided around the discharge product removing member 4.

With the structure, it is possible to improve a catalytic reactivity of a photocatalyst component such as titanium oxide by irradiating light from the through-hole 4*a* in the discharge product removing member 4 on a side of air flow exit. This allows improving a filtration performance.

As described above, the present structure can achieve both stable electric charge supply to the photoreceptor 11 and high trapping efficiency for discharge products.

Note that the technology is not limited to the foregoing embodiments, and a variety of modifications are possible within the scope specified by claims. Embodiments obtained by combining technical means disclosed in different embodiments are also included in technical means of the technology.

INDUSTRIAL APPLICABILITY

The technology is applicable to various electrophotographic copiers as a device for uniform charging of a photoreceptor drum, and for transferring a toner image formed on a photoreceptor drum to a belt or paper.

The invention claimed is:

1. A corona discharge device comprising:

a discharge electrode for causing electric discharge;

a discharge product removing member provided around the discharge electrode, and containing a material capable of removing a discharge product, wherein the discharge product removing member has cells of a honeycomb structure, and wherein the cells of the honeycomb structure fulfill $T/C \geqq 0.8$ and $(NS)/T \geqq 0.032$, where T is a thickness of the cell (mm), C is a circumference of a cell hole (mm), N is a number of cells (cel/mm$^2$), and S is a cross-sectional area of a cell hole (mm$^2$); and a shield member interposed between the discharge electrode and the discharge product removing member, having a through-hole open toward the discharge electrode, and having a surface opposed to the discharge electrode, and at least the surface being made of a metallic material.

2. The corona discharge device as set forth in claim 1, wherein:

the through-hole in the shield member is opened toward the discharge product removing member; and the discharge product removing member has a through-hole being opened toward the shield member.

3. The corona discharge device as set forth in claim 1, wherein:

the discharge product removing member and the shield member are integrated by being made of a single-piece base material.

4. The corona discharge device as set forth in claim 1, wherein:

the discharge product removing member is made of a plurality of layers of base materials.

5. The corona discharge device as set forth in claim 4, wherein:

each of the base materials of the discharge product removing member is individually coated with a different discharge product removing material.

6. The corona discharge device as set forth in claim 1, wherein:

the through-hole in the shield member has a smaller cross-sectional area than that of the through-hole in the discharge product removing member.

7. The corona discharge device as set forth in claim 1, wherein:

the through-hole in the shield member has a wavy cross-sectional structure in a thickness direction.

8. The corona discharge device as set forth in claim 1, further comprising:

a slit electrode for controlling a voltage between the discharge electrode and the shield member, the slit electrode being provided in an opening section which is located in a surrounding area of the discharge electrode and in which none of the discharge product removing member and the shield member in the surrounding area are provided.

9. The corona discharge device as set forth in claim 8, wherein:

an electric potential difference between the discharge electrode and the shield member is larger than an electric potential difference between the discharge electrode and the slit electrode.

10. The corona discharge device as set forth in claim 9, comprising:

another electrode at each of both sides of an opening section, the opening section being in a surrounding area of the discharge electrode and having none of the discharge product removing member, the shield member, and the slit electrode, wherein an electric potential difference is applied between the another electrode.

11. The corona discharge device as set forth in claim 8, wherein:

an opening section in a surrounding area of the discharge electrode is provided only between the shield member and the slit electrode; and an electric potential difference between the discharge electrode and the shield member is smaller than an electric potential difference between the discharge electrode and the slit electrode.

12. The corona discharge device as set forth in claim 1, comprising:

a discharge electrode extraneous matter removing section in one direction in a surrounding area of the discharge electrode.

13. The corona discharge device as set forth in claim 1, comprising:

an exhaust air duct in a surrounding area of the discharge product removing member.

14. The corona discharge device as set forth in claim 1, comprising:

a light source in a surrounding area of the discharge product removing member.

15. The corona discharge device as set forth in claim 1, wherein:

the material capable of removing discharge products is manganous oxide.

16. The corona discharge device as set forth in claim 1, wherein:

the material capable of removing discharge products is titanium oxide.

17. A photoreceptor charger comprising:

a corona discharge device comprising:

a discharge electrode for causing electric discharge;

a discharge product removing member provided around the discharge electrode, and containing a material capable of removing a discharge product, wherein the discharge product removing member has cells of a honeycomb structure, and wherein the cells of the honeycomb structure fulfill $T/C \geqq 0.8$ and $(NS)/T \geqq 0.032$, where T is a thickness of the cell (mm), C is a circumference of a cell hole (mm), N is a number of cells (cel/mm$^2$), and S is a cross-sectional area of a cell hole (mm$^2$); and a shield member interposed between the discharge electrode and the discharge product removing member, having a through-hole open toward the discharge electrode, and having a surface opposed to the discharge electrode, and at least the surface being made of a metallic material, and an airflow block board, which is provided between the corona discharge device and a photoreceptor provided opposing to the corona discharge device, for preventing inflow and outflow of air between the corona discharge device and the photoreceptor.

18. A method for making a discharge product removing member for use in a corona discharge device, the corona discharge device comprising:

a discharge electrode for causing electric discharge;

a discharge product removing member provided around the discharge electrode, and containing a material capable of removing discharge products, wherein the discharge product removing member has cells of a honeycomb structure, and wherein the cells of the honeycomb structure fulfill $T/C \geqq 0.8$ and $(NS)/T \geqq 0.032$, where T is a thickness of the cell (mm), C is a circumference of a cell hole (mm), N is a number of cells (cel/$mm^2$), and S is a cross-sectional area of a cell hole ($mm^2$); and a shield member interposed between the discharge electrode and the discharge product removing member, having a through-hole open toward the discharge electrode, and having a surface opposed to the discharge electrode, and at least the surface being made of a metallic material, and the method comprising:

coating porous base materials, respectively, with different discharge product removing materials; and forming the discharge product removing member from a plurality of layers of the porous base materials.

* * * * *